US010446981B2

(12) United States Patent
Furuya et al.

(10) Patent No.: US 10,446,981 B2
(45) Date of Patent: Oct. 15, 2019

(54) ELECTRICAL CONNECTOR

(71) Applicant: Tyco Electronics Japan G.K., Kanagawa (JP)

(72) Inventors: Sumiyoshi Furuya, Kanagawa (JP); Shinji Amemiya, Kanagawa (JP); Fumito Nagashima, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/951,640

(22) Filed: Apr. 12, 2018

(65) Prior Publication Data

US 2018/0301848 A1 Oct. 18, 2018

(30) Foreign Application Priority Data

Apr. 12, 2017 (JP) ..... 2017-078734

(51) Int. Cl.
*H01R 4/56* (2006.01)
*H01R 13/631* (2006.01)
(Continued)

(52) U.S. Cl.
CPC ..... *H01R 13/6315* (2013.01); *H01R 11/03* (2013.01); *H01R 13/24* (2013.01);
(Continued)

(58) Field of Classification Search
CPC ..... H01R 13/6315; H01R 13/6297; H01R 13/521; H01R 13/4538; H01R 13/24;
(Continued)

(56) References Cited

U.S. PATENT DOCUMENTS 6,604,952 B2 8/2003 Miwa et al.
6,805,564 B2 * 10/2004 Shinozaki ..... H01R 13/518 439/157
(Continued)

FOREIGN PATENT DOCUMENTS

EP 0330436 A2 8/1989
EP 1443607 A2 8/2004
(Continued)

OTHER PUBLICATIONS

Extended European Search Report, Application No. 18167000.1, dated Jun. 14, 2018, 10 pages.
(Continued)

*Primary Examiner* — Jean F Duverne
(74) *Attorney, Agent, or Firm* — Barley Snyder

(57) ABSTRACT

An electrical connector comprises a plurality of terminals, a housing holding the plurality of terminals, and a movable member. The movable member moves with respect to the housing and the terminals between a front position and a rear position along a mating direction in which the housing is mated with a mating housing. The movable member includes an opening wall having a plurality of openings into which the terminals move in and out along the mating direction according to a movement of the movable member and an insulation wall disposed frontward of the opening wall in the mating direction. The insulation wall is disposed between a portion of the terminals protruding from the openings adjacent to each other in the rear position of the movable member.

10 Claims, 7 Drawing Sheets

(51) Int. Cl.

| | |
|---|---|
| ***H01R 13/74*** | (2006.01) |
| ***H01R 11/03*** | (2006.01) |
| ***H01R 13/44*** | (2006.01) |
| ***H01R 13/24*** | (2006.01) |
| ***H01R 13/453*** | (2006.01) |
| ***H01R 13/52*** | (2006.01) |
| *H01R 103/00* | (2006.01) |

(52) U.S. Cl.
CPC ..... *H01R 13/44* (2013.01); *H01R 13/4538* (2013.01); *H01R 13/521* (2013.01); *H01R 13/743* (2013.01); *H01R 13/748* (2013.01); *H01R 2103/00* (2013.01)

(58) Field of Classification Search
CPC ..... H01R 13/6293; H01R 13/62955; H01R 13/6235; H01R 13/518; H01R 11/03; H01R 2103/00; H01R 13/748; H01R 13/743
USPC ..... 439/248
See application file for complete search history.

(56) References Cited

U.S. PATENT DOCUMENTS

| | | | | |
|---|---|---|---|---|
| 7,361,036 | B2 * | 4/2008 | Pittenger ..... | H01R 13/62955 439/157 |
| 7,473,113 | B2 * | 1/2009 | Koda ..... | H01R 13/6335 439/157 |
| 7,744,390 | B2 * | 6/2010 | Tyler ..... | H01R 13/62927 439/157 |
| 8,057,245 | B2 * | 11/2011 | Sakamaki ..... | H01R 13/62933 439/157 |
| 9,520,669 | B2 * | 12/2016 | Gerwatowski ..... | H01R 13/44 |
| 2003/0003786 | A1 | 1/2003 | Bakker | |

FOREIGN PATENT DOCUMENTS

| | | | |
|---|---|---|---|
| JP | 2001-266994 | A | 9/2001 |
| JP | 2003-151672 | A | 5/2003 |
| WO | 2014122977 | A1 | 8/2014 |

OTHER PUBLICATIONS

Abstract of JP 2001-266994, dated Sep. 28, 2001, 1 page.
Abstract of JP2003-151672, dated May 23, 2003, 1 page.

* cited by examiner

ELECTRICAL CONNECTOR

CROSS-REFERENCE TO RELATED APPLICATION

This application claims the benefit of the filing date under 35 U.S.C. § 119(a)-(d) of Japanese Patent Application No. 2017-078734, filed on Apr. 12, 2017.

FIELD OF THE INVENTION

The present invention relates to an electrical connector and, more particularly, to an electrical connector having a housing and a member movable with respect to the housing.

BACKGROUND

In an electrical connector, it is necessary to insulate a plurality of terminals from one another to prevent short-circuiting between the terminals. A predetermined space is set between the terminals according to safety standards. Alternatively, as described in Japanese Patent Application No. 2003-151672A, a wall is provided between the terminals to elongate a creepage distance. The wall permits a shortening of the space between the terminals and permits an overall size reduction of the connector.

In the electrical connector in JP 2003-151672A, in addition to disposing a wall formed in a housing between respective main bodies of a pair of terminal fittings, leak between the terminal fittings is further prevented by arranging a wall formed in a retainer between respective stabilizers of the pair of terminal fittings. According to the connector described in JP 2003-151672A, the creepage distance for insulation is lengthened to prevent the short-circuiting by the wall of the retainer and the wall of the housing, however, there is a risk that an operator's finger can touch a distal end of the terminal fitting exposed inside the housing and the operator could receive an electrical shock.

SUMMARY

An electrical connector comprises a plurality of terminals, a housing holding the plurality of terminals, and a movable member. The movable member moves with respect to the housing and the terminals between a front position and a rear position along a mating direction in which the housing is mated with a mating housing. The movable member includes an opening wall having a plurality of openings into which the terminals move in and out along the mating direction according to a movement of the movable member and an insulation wall disposed frontward of the opening wall in the mating direction. The insulation wall is disposed between a portion of the terminals protruding from the openings adjacent to each other in the rear position of the movable member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
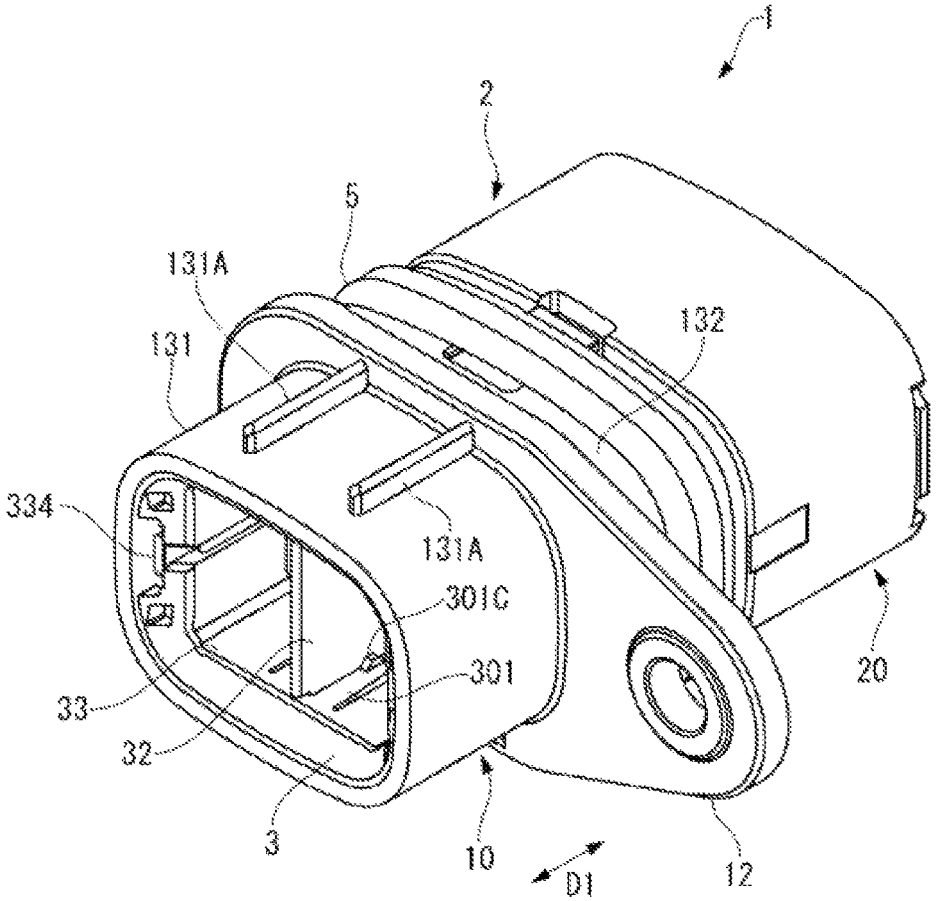
FIG. 1 is a perspective view of an electrical connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 4:
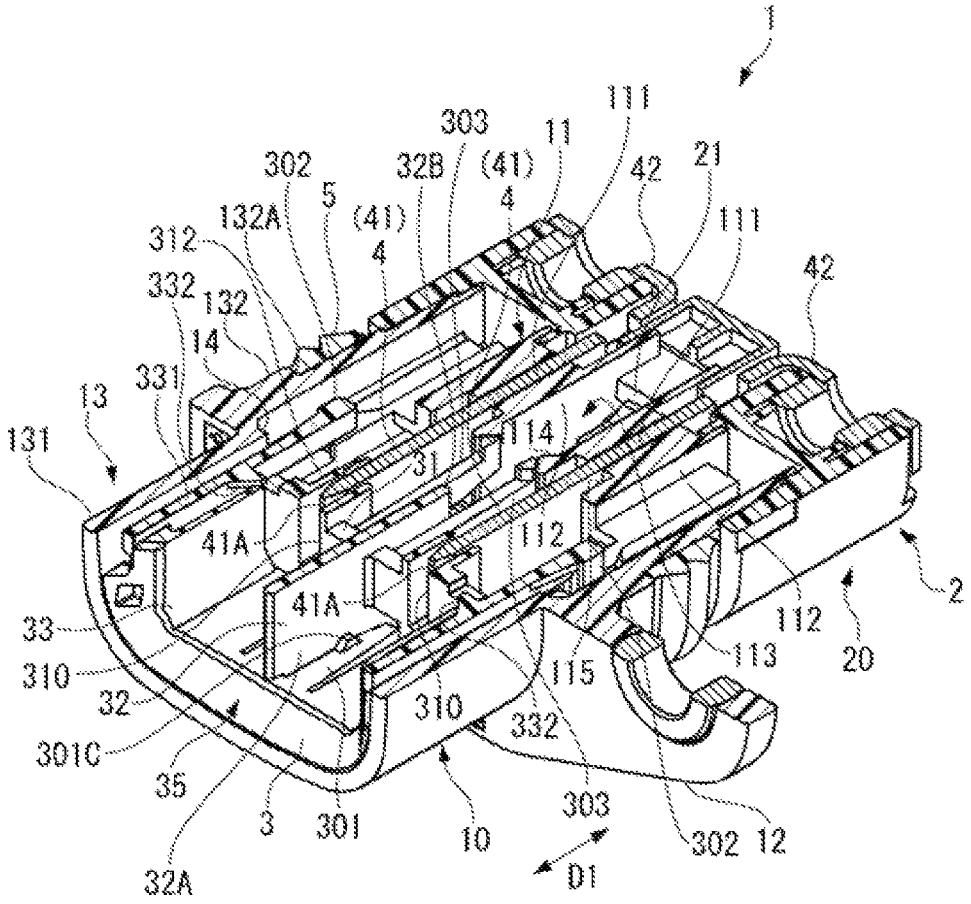
FIG. 4 is a sectional perspective view of the electrical connector with a movable member of the electrical connector in a front position.

An electrical connector 1 according to an embodiment is shown in FIG. 1. The electrical connector 1 has a plurality of terminals 4, as shown in FIG. 4, a housing 2 holding the terminals 4, and a movable member 3 movable with respect to the terminals 4 and the housing 2 along a mating direction D1.

In an embodiment, the terminals 4 are male terminals. In the shown embodiment, the electrical connector 1 is a two-position electrical connector having two male terminals 4. The electrical connector 1 may be installed in a device mounted on a vehicle. In an embodiment, the electrical connector 1 is suitable for electrical connection to a high-voltage device such as a power source, a generator, or the like, mounted on the vehicle. In other embodiments, the electrical connector 1 can have three or more positions provided with three or more terminals 4.

Figure 2:
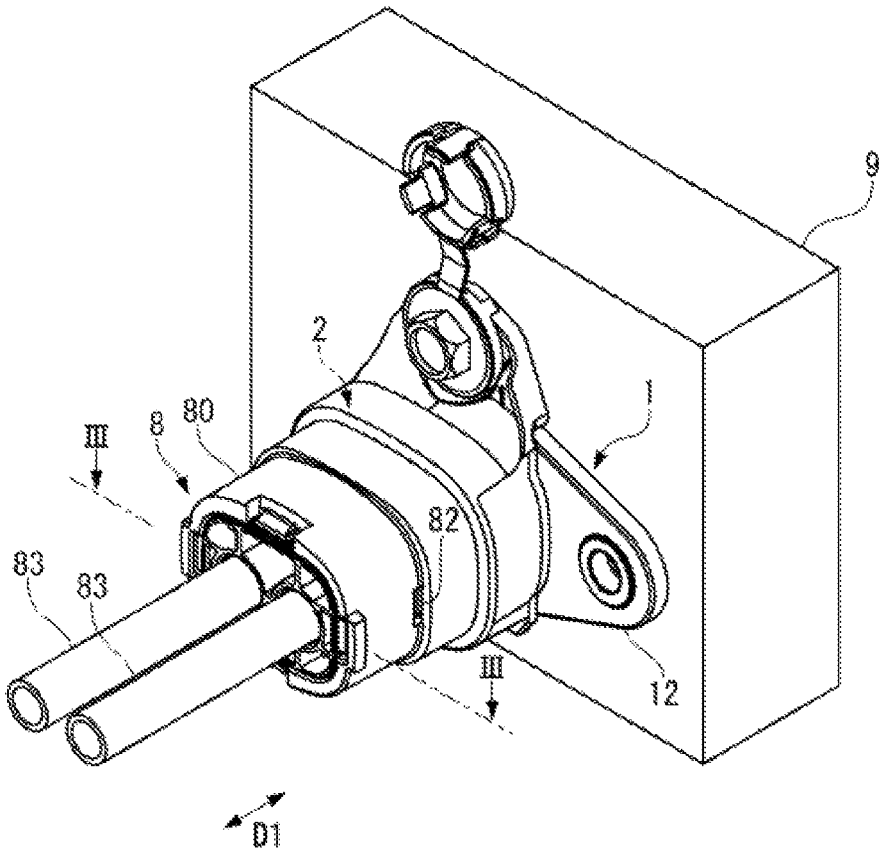
FIG. 2 is a perspective view of the electrical connector of FIG. 1 mated with a mating connector.

As shown in FIG. 2, the electrical connector 1 is matable with a mating connector 8. In the embodiment shown in FIGS. 3 and 7, the mating connector 8 has two female terminals 81 and a mating housing 80 holding the terminals 81. The terminals 81 are each connected to an electrical wire 83. Throughout the description, a side of the electrical connector 1 on which the electrical connecter 1 is mated with the mating connector 8 along the mating direction D1 is defined as "front" and the opposite side thereto is defined as "rear".

As shown in FIG. 2, the housing 2 and the mating housing 80 are mated with each other such that an outer peripheral portion of the housing 2 protruding from a casing 9 of the device is covered with the mating housing 80. A portion of the mating housing 80 which has been inserted inside the housing 2 and the movable member 3 pushes the movable member 3 rearward so that the terminals 81 each come into contact with one of the terminals 4 which have been exposed inside the movable member 3. The terminals 81 are thereby electrically connected to the terminals 4.

The electrical connector 1, as shown in FIGS. 1 and 4, has the housing 2, which includes a first housing 10 and a second housing 20, the terminals 4 held by the housing 2, an annular seal 5, and the movable member 3.

The terminal 4 is a conductor formed from a metal material. The terminal 4, as shown in FIG. 4, has a tabular contact portion 41 and a connection portion 42 connected to and continuous with a rear end of the contact portion 41. The connection portion 42 is electrically connected to an electrical part inside the casing 9. The respective contact portions 41 of the terminals 4 are disposed inside the first housing 10 parallel to the mating direction D1 such that flat wide faces of the contact portions 41 face each other.

The first housing 10, the second housing 20, and the movable member 3 are each an insulator formed from a resin material.

The first housing 10, as shown in FIG. 4, has a holding portion 11 for holding a proximal end side of the contact portion 41, an attaching portion 12 attached to the casing 9, and a receiving recess 13 extending frontward from the holding portion 11 to receive a distal end side of the contact portion 41. The holding portion 11, the attaching portion 12, and the receiving recess 13 are integrally formed by injection molding.

As shown in FIG. 4, the holding portion 11 has insertion holes 111 with a rectangular cross-sectional shape into which the pair of contact portions 41 are inserted. The proximal end side of the contact portion 41 inserted into the insertion hole 111 is concealed by a block 112 in the holding portion 11 for each contact portion 41. An air gap 113 is formed between one block 112 and the other block 112 and an inner wall of the receiving recess 13. The respective proximal end sides of the contact portions 41 are insulated from each other by the block 112 and the gap 113 present between the pair of contact portions 41.

The attaching portion 12 is disposed frontward of a position of the holding portion 11 and is fixed to the casing 9 by a screw.

The receiving recess 13, as shown in FIGS. 1 and 4, has a frontward hood 131 protruding frontward from the attaching portion 12, and a rearward hood 132 continuing into the holding portion 11 behind the attaching portion 12. The second housing 20 is assembled to a rear side of the rearward hood 132.

As shown in FIGS. 1 and 4, the frontward hood 131 has a cylindrical shape with a rectangular cross section having rounded four corners, and surrounds the distal end sides of the contact portions 41. The frontward hood 131 protrudes from the position of the attaching portion 12 to a frontward position beyond a front end 41A of the contact portion 41. Ridges 131A for guiding the mating connector 80 during mating are formed on an outer peripheral portion of the frontward hood 131 along the mating direction D1.

The second housing 20 forms the rear end portion of the electrical connector 1 as shown in FIGS. 1 and 4. The second housing 20 has a passageway into which proximal ends of the contact portions 41 and the connection portions 42 are inserted.

When the electrical connector 1 is assembled, the annular seal 5 is disposed on an outer peripheral portion of the rearward hood 132 as shown in FIG. 1. Next, the second housing 20 is assembled to the rear side of the rearward hood 132. Then, when the terminals 4 are inserted into the passageway of the second housing 20 from behind, the contact portions 41 are inserted into the insertion holes 111 of the first housing 10, and the connection portions 42 are plugged to the rear end portion of the second housing 20. Subsequently, the movable member 3 is inserted into the first housing 10 from the front of the first housing 10.

Figure 3:
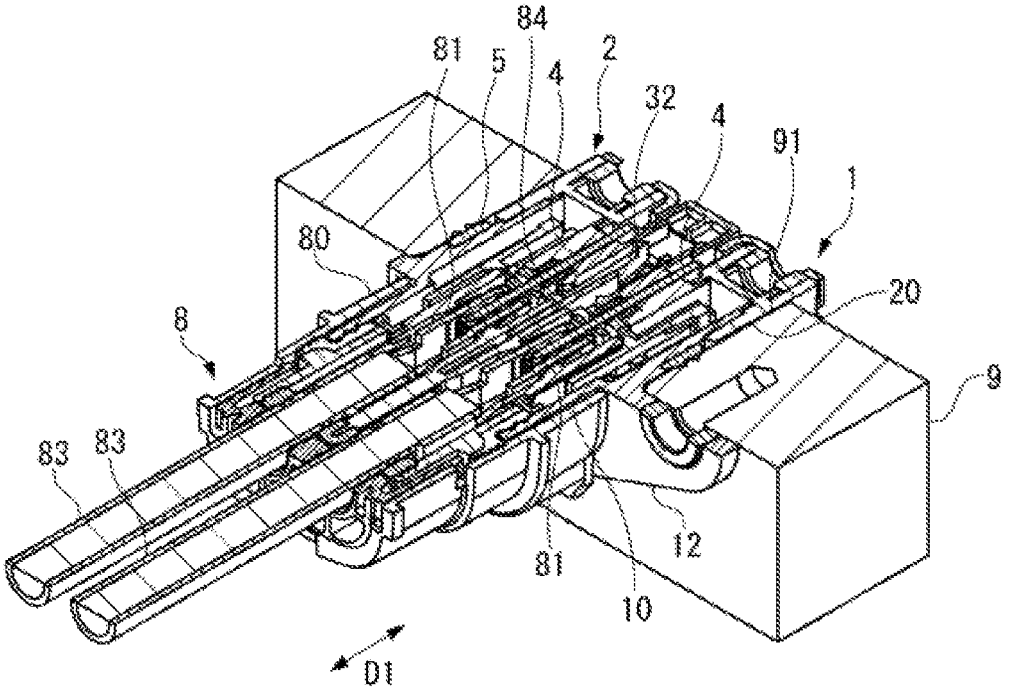
FIG. 3 is a sectional perspective view of the electrical connector and the mating connector taken along line III-III in FIG. 2.

The casing 9 has a hole 91 shown in FIG. 3 for installing the electrical connector 1. A portion of the electrical connector 1 located behind the attaching portion 12 is inserted into the hole 91, and the attaching portion 12 is fixed to the casing 9 by a screw. A gap between the electrical connector 1 and the casing 9 is sealed by the annular seal 5 pressed between the outer peripheral portion of the rearward hood 132 and the inner peripheral portion of the hole 91 for installation.

Figure 5:
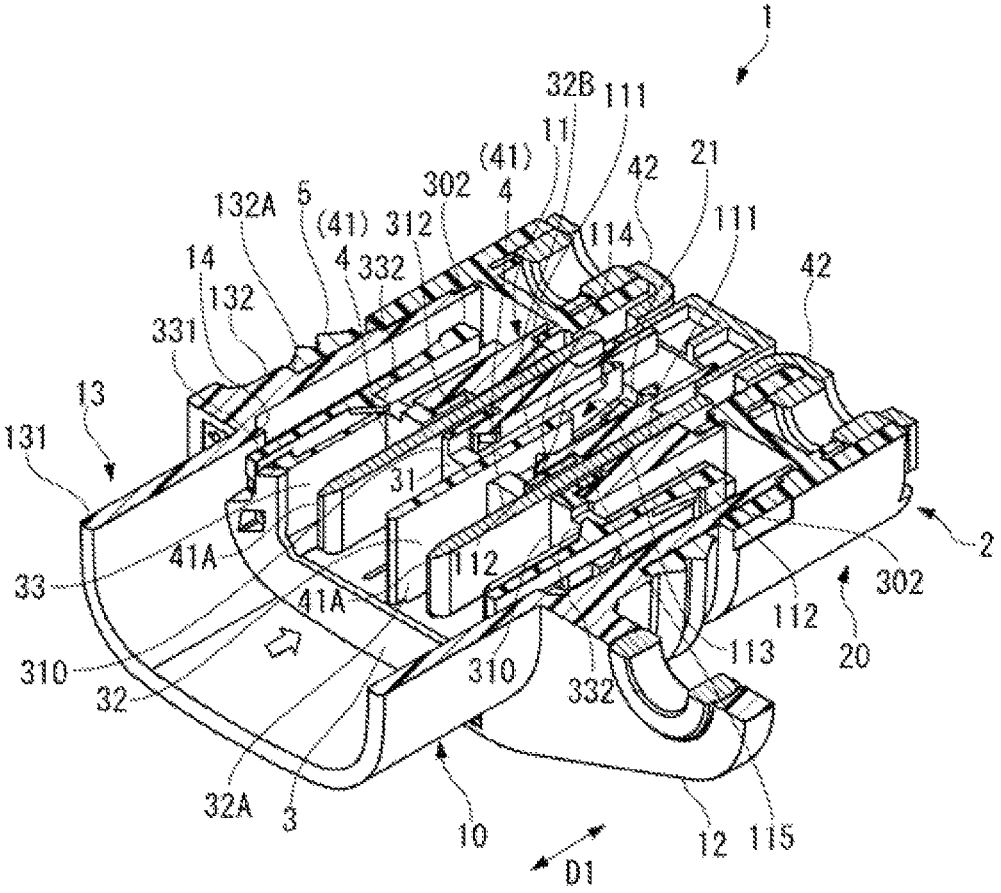
FIG. 5 is a sectional perspective view of the electrical connector with the movable member in a rear position.

The movable member 3 is capable of advancing and retreating with respect to the housing 2 and the terminals 4 between a front position shown in FIG. 4 and a rear position shown in FIG. 5. As shown in FIG. 4, the movable member 3 has an opening wall 31, an insulation wall 32 and a side wall 33. In an embodiment, the movable member 3 is integrally formed in a single piece. The opening wall 31 and the side wall 33 constitute a mating recess 35 into which the mating housing 80 is inserted toward the opening wall 31.

During mating, a portion of the movable member 3 is pushed by the mating housing 80 inserted into the side wall 33, so that the movable member 3 is retreated to the rear position shown in FIG. 5. At that time, the contact portion 41 protruding frontward from the opening 310 of the opening wall 31 and the terminal 81 are brought into contact with each other, and the mating housing 80 is mated with the movable member 3 and the first housing 10.

Figure 6:
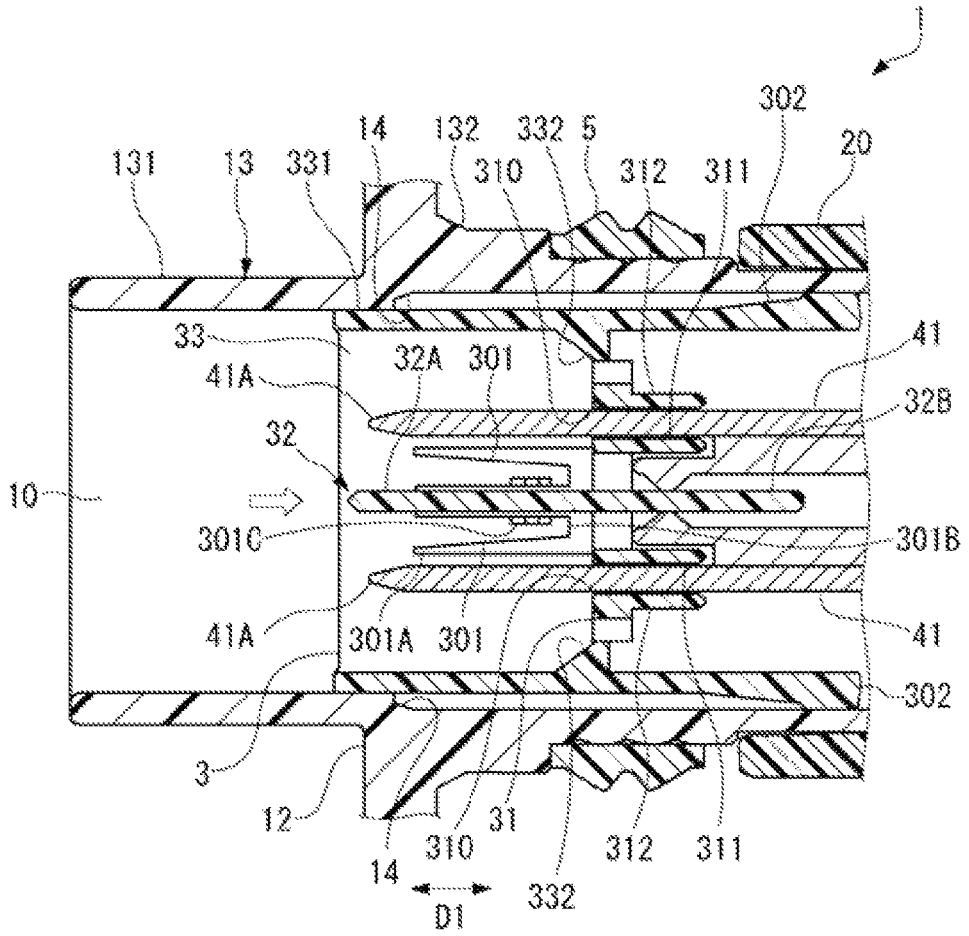
FIG. 6 is a sectional plan view of the electrical connector with the movable member in the rear position.

As shown in FIGS. 4-6, the opening wall 31 is disposed inside the first housing 10 and extends in a direction orthogonal to the mating direction D1. The opening wall 31 has a passageway 311 which the contact portion 41 penetrates when the movable member 3 has been retreated. The passageway 311 has an opening 310 with a rectangular cross-sectional shape through which the distal end side of the contact portion 41 moves into and out of according to the direction of movement of the movable member 3. In the opening wall 31, an accommodation portion 312 for accommodating the front end 41A of the contact portion 41 when the movable member 3 has advanced to the front position is formed so as to continue to the rear side of the opening 310. Lateral motion of the distal end side of the contact portion 41 is restrained by the accommodation portion 312. The accommodation portion 312 is inserted into a recess 115 formed at a front end of the block 112 when the movable member 3 has been retreated to the rear position shown in FIG. 5.

As shown in FIG. 4, when the movable member 3 has advanced, the front end 41A of the contact portion 41 is retreated in the opening 310 and the opening wall 31 is located ahead of the front end 41A of the contact portion 41. Therefore, a finger of an operator or the like is prevented from touching the contact portion 41 by the opening wall 31. The opening wall 31 prevents an electrical shock.

The insulation wall 32, as shown in FIGS. 4-6, is displaced along the mating direction D1 according to advance and retreat of the movable member 3. The insulation wall 32 is formed in a rectangular plate shape and is disposed at a center in a widthwise direction of the movable member 3 so as to extend along the mating direction D1 in parallel with the contact portion 41. The insulation wall 32 partitions an inner space of the movable member 3 so as to couple an upper portion and a lower portion of the side wall 33.

The insulation wall 32 increases a creepage distance for insulation between a first set of terminals 4, 81 contacting one another and an adjacent second set of terminals 4, 81 contacting one another. Short-circuiting between the two positions is therefore prevented. In various embodiments, the position or length of the insulation wall 32 in the mating direction D1 can be set appropriately according to the creepage distance for insulation or the space distance required between the positions. That is, it is possible to lengthen or shorten a dimension of the insulation wall 32 in the mating direction D1 or shift the insulation wall 32 frontward or rearward. In another embodiment in which the electrical connector 1 has three terminals 4 arranged in the widthwise direction of the electrical connector 1, two insulation walls 32 disposed between adjacent terminals 4, respectively, are provided on the movable member 3.

Insulation between the positions is achieved by the insulation wall 32 provided on the movable member 3 both when the electrical connector 1 and the mating connector 8 has been temporarily mated with each other and when they have been finally mated with each other. In order to achieve insulation between the positions both at the temporary mating time and the final mating time by the insulation wall 32, the insulation wall 32 protrudes from the opening wall 31 both frontward and rearward. The insulation wall 32 has a front portion 32A protruding frontward from the opening wall 31 and a rear portion 32B protruding rearward from the opening wall 31.

Figure 7:
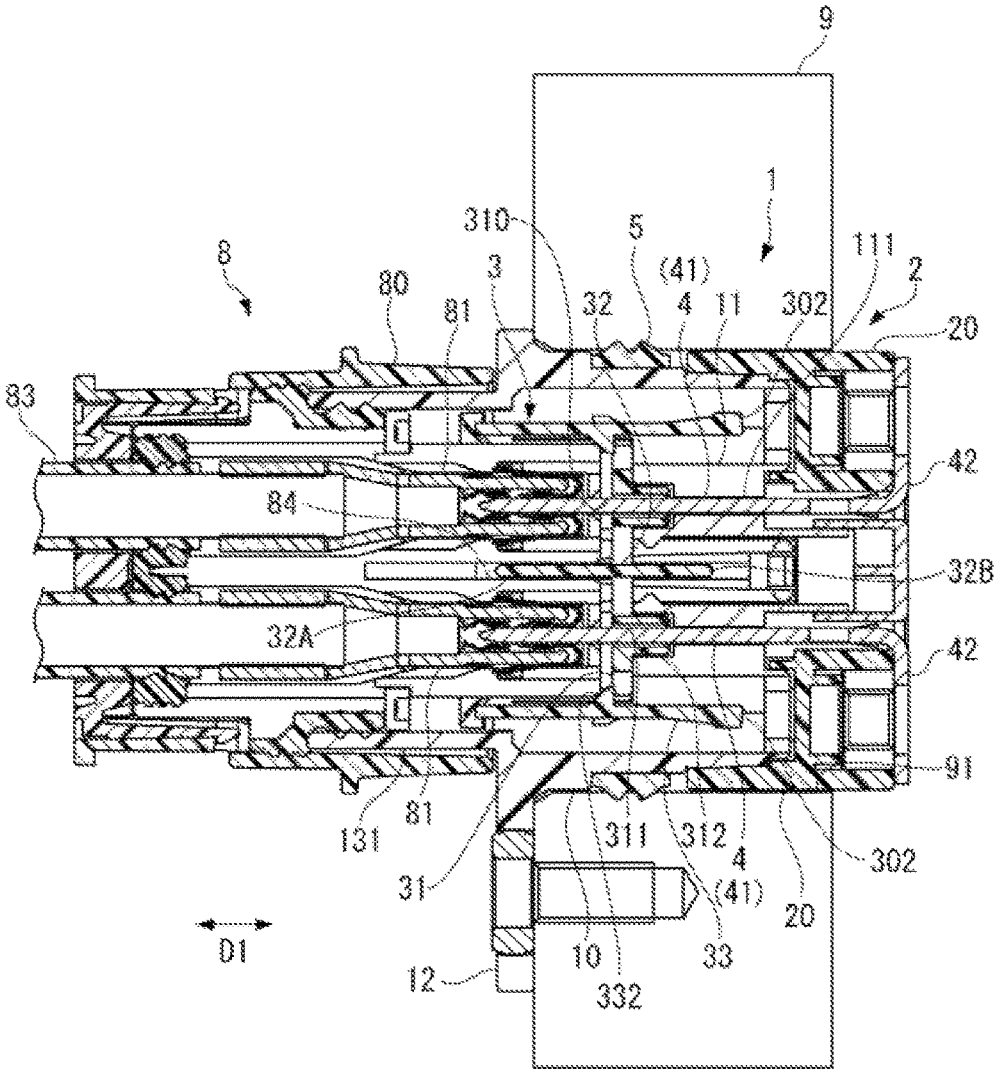
FIG. 7 is a sectional plan view of the electrical connector and the mating connector in a fully mated position.

The mating housing 80 has a groove 84, as shown in FIGS. 3 and 7, extending along the mating direction D1 into which the front portion 32A of the insulation wall 32 is inserted. When the movable member 3 is retreated as shown in FIG. 5, the insulation wall 32 is disposed between the contact portions 41 which are adjacent to each other and protrude from the openings 310 of the opening wall 31.

As shown in FIGS. 4-6, the side wall 33 extends ahead of the opening wall 31 and is disposed along an inner peripheral portion of the first housing 10. The side wall 33 surrounds the plurality of contact portions 41 and is formed in an approximately cylindrical shape. The movable member 3 is guided in the mating direction D1 by rails 331 formed on the side wall 33 along the mating direction D1 and ridges or grooves formed on an inner peripheral portion of the first housing 10 meshing with the rails 331. The rail 331 is formed with a protrusion 332 pushed by the mating housing 80 inserted into the movable member 3.

The side wall 33, as shown in FIGS. 4-6, has an engagement beam 301, a retaining beam 302, and a stopper beam 303.

The engagement beam 301, as shown in FIG. 6, makes the movable member 3 follow the mating connector 8 when the mating connector 8 is pulled out from the electrical connector 1. The engagement beam 301 has a supporting end 301A located in the vicinity of a front end of the side wall 33, and a free end 301B located behind the supporting end 301A. The engagement beam 301 is formed with a protrusion 301C for engaging with a recess of the mating housing 80 during retreat of the movable member 3. The engagement beams 301 are formed integrally with the side wall 33 on both sides of the insulation wall 32 in a plate thickness direction thereof. The engagement beams 301 are formed at the lower portion of the side wall 33 and the upper portion of the side wall 33. In another embodiment, instead of providing the side wall 33 with the engagement beam 301, the insulation wall 32 may be provided with the engagement beam 301.

When the movable member 3 is advanced to the front position shown in FIG. 4, the retaining beam 302 is caught to the first housing 10 so that detachment of the movable member 3 from the first housing 10 is prevented.

An operation of the electrical connector 1 will now be described in greater detail.

As shown in FIG. 4, when the electrical connector 1 is not mated with the mating connector 8, in a non-mating state, the movable member 3 is advanced to the front position. At this time, rearward movement of the movable member 3 is restrained by the retaining beam 302. In the internal space of the first housing 10 and the movable member 3 in the non-mating state, the contact portion 41 is retreated rearward beyond the opening 310 of the opening wall 31. In addition, since the insulation wall 32 is located at a center of the internal space in the widthwise direction, it is hard for a finger of an operator to enter the backs of the first housing 10 and the movable member 3. Electrical shock is thereby prevented in the non-mating state.

During mating of the electrical connector 1 and the mating connector 8, the mating connector 80 is first inserted into the first housing 10 and the movable member 3. A state where the mating connector 80 is in the middle of insertion is defined as a temporary mating state. When the mating housing 80 is inserted deeper beyond the position of the temporary mating position and the movable member 3 pushed by the mating connector 80 is retreated to the rear position shown in FIG. 5, the final mating state is achieved.

The electrical connector 1 is shown in the temporary mating state in FIG. 4. The terminal 81 of the mating connector 8 is located close to the front end 41A of the contact portion 41. The insulation wall 32 is inserted into the groove 84 of the mating connector 80.

In the temporary mating state, the opening wall 31 is located between the front end 41A of the male-type terminal 4 and the distal end of the female-type terminal 81. In addition, the front portion 32A of the insulation wall 32 protruding frontward from the opening wall 31 is located between the female-type terminals 81 adjacent to each other, and the rear portion 32B of the insulation wall 32 protruding rearward from the opening wall 31 is located between the male-type terminals 4 adjacent to each other. That is, because the insulation wall 32 and the opening wall 31 are disposed between the positions adjacent to each other, a creepage distance for insulation required between the positions can be sufficiently secured in the temporary mating state.

During insertion of the mating housing 80 into the first housing 10 and the movable member 3, the protrusion 332 of the side wall 33 of the movable member 3 is pushed by the front end of the mating housing 80. A rear end portion of the stopper beam 303 gets over a protrusion 114 of the block 112, and the entire movable member 3 is retreated relative to the housing 2 along the mating direction D1.

The contact portion 41 then protrudes frontward from the opening 310 of the opening wall 31 and the female-type terminal 81 held by the mating connector 80 pinches the contact portion 41 from both sides of the contact portion 41. The contact portion 41 comes into contact with a predetermined contact point of the female-type terminal 81. The mating housing 80 is pushed until the stopper beam 303 comes into contact with the stopper wall 21 of the second housing 20, and a lock protrusion 334 of the side wall 33 shown in FIG. 1 is caught in the lock portion 82 of the mating housing 80 shown in FIG. 2 so that the electrical connector 1 and the mating connector 8 are finally mated with each other. A final mated state of the connector 1 and the mating connector 8 is shown in FIGS. 2, 3, and 7.

When the electrical connector 1 and the mating connector 8 are mated with each other in the final mated state, as shown in FIG. 7, the insulation wall 32 is located between the sets of terminals 4, 81 both in a place where the contact portion 41 is exposed between the opening wall 31 of the movable member 3 and the front end of the mating housing 80 and over a predetermined region in front of and behind where the contact portion 41 is exposed.

The front portion 32A of the insulation wall 32 is located between the male-type terminal 4 and the female-type terminal 81 located on the upper side of FIG. 7 and the male-type terminal 4 and the female-type terminal 81 located on the lower side of FIG. 7 over the entire length of a protruding portion of the contact portion 41 protruding from the opening wall 31. The male-type terminal 4 and the female-type terminal 81 located on the upper side correspond to one position, and the male-type terminal 4 and the female-type terminal 81 located on the lower side correspond to an adjacent position adjacent to the one position. The insulation wall 32 is thereby disposed between the positions adjacent to each other in a region where the male-type terminal 4 is pinched by the female-type terminal 81, namely, a region where the male-type terminal 4 and the female-type terminal 81 overlap with each other, as well as in the place where the contact portion 41 is not covered with an insulator such as the first housing 10, the movable member 3, or the mating housing 80.

As shown in FIG. 7, the opening wall 31 which is a proximal end of the front portion 3, and the rear portion 32B of the insulation wall 32 are located between the positions adjacent to each other from the accommodation portion 312 to the place where the contact portion 41 has been inserted into the insertion hole 111 of the holding portion 11. Accordingly, even in the final mating state, since the insulation wall 32 and the opening wall 31 are disposed between the positions adjacent to each other, a creepage distance for insulation required between the positions can be sufficiently secured.

When the mating housing 80 is pulled out from the housing 2 in order to unmate the electrical connector 1 and the mating connector 8, the movable member 3 follows the mating housing 80 to return to the front position because the protrusion 301C of the engagement beam 301 and the mating housing 80 engage with each other. When the mating housing 80 is pulled out frontward from the movable member 3 caught on the first housing 10 by the retaining beam 302, the mating housing 80 can be separated from the movable member 3 because the protrusion 301C disengages from the mating housing 80 due to deflection of the engagement beam 301 in the plate thickness direction.

In the electrical connector 1, because the insulation wall 32 is provided on the movable member 3, the insulation wall 32 is located between the mating terminals 4, 81 both in the temporary mating state and the final mating state. Therefore, both in the temporary mating state and in the final mating state, since the creepage distance for insulation between the positions can be sufficiently secured, short-circuiting between the positions can be prevented reliably even in a high-voltage application. The spacing between adjacent terminals 4, 81 can thereby be reduced, permitting a reduction in an overall size of the electrical connector 1 and the mating connector 8.

In the electrical connector 1, when the mating housing 80 is pushed in, since the movable member 3 is retreated and the insulation wall 32 is also displaced rearward according to the retreat of the movable member 3, the depth of the groove 84 into which the insulation wall 32 is inserted is only required to allow insertion of the front portion 32A of the insulation wall 32 in the temporary mating state. On the contrary, if the insulation wall 32 is formed in the housing 2 as in the prior art, the insulation wall 32 is not displaced relative to the housing 2 and the terminals 4 and it would therefore be necessary to lengthen the insulation wall 32 in the mating direction D1 in order to prevent short-circuiting. This would also require a deeper groove 84 which is difficult to mold with a high accuracy. Therefore, because the movable member 3 of the electrical connector 1 disclosed herein has the insulation wall 32, a size accuracy of the mating housing 80 can be secured by shortening the length of the insulation wall 32 in the mating direction D1 while short-circuiting between the positions is reliably prevented both in the temporary mating state and in the final mating state.

What is claimed is:

1. An electrical connector comprising:

a plurality of terminals;

a housing holding the plurality of terminals; and a movable member moving with respect to the housing and the terminals between a front position and a rear position along a mating direction in which the housing is mated with a mating housing, the movable member including:

an opening wall located between each terminal and having a plurality of openings into which the terminals move in and out along the mating direction according to a movement of the movable member; and an insulation wall disposed frontward of the opening wall in the mating direction, the insulation wall disposed between a portion of the terminals protruding from the openings adjacent to each other in the rear position of the movable member.

2. The electrical connector of claim 1, wherein the insulation wall is disposed between an entire length of the portion of the terminals protruding from the openings adjacent to each other in the rear position.

3. The electrical connector of claim 1, wherein the insulation wall extends both frontward and rearward from the opening wall in the mating direction.

4. The electrical connector of claim 1, wherein the movable member has a side wall extending frontward of the opening wall in the mating direction and along an inner peripheral portion of the housing.

5. The electrical connector of claim 4, wherein the side wall has an engagement beam engaging the mating housing.

6. The electrical connector of claim 1, wherein the movable member has a mating recess into which the mating housing is inserted along the mating direction toward the opening wall.

7. The electrical connector of claim 6, wherein a first terminal of the terminals contacts a first mating terminal of the mating housing at a first position and a second terminal of the terminals contacts a second mating terminal of the mating housing at a second position adjacent to the first position.

8. The electrical connector of claim 7, wherein, in a temporary mating state in which the mating housing is inserted into the mating recess and the movable member is in the front position, the insulation wall is disposed between the first position and the second position in a direction perpendicular to the mating direction.

9. The electrical connector of claim 8, wherein, in a final mating state in which the movable member is pushed by the mating housing into the rear position, the insulation wall is disposed between the first position and the second position in the direction perpendicular to the mating direction.

10. An electrical connector comprising:

a plurality of terminals;

a housing holding the plurality of terminals; and a movable member moving with respect to the housing and the terminals between a front position and a rear position along a mating direction in which the housing is mated with a mating housing, the movable member including:

an opening wall having a plurality of openings into which the terminals move in and out along the mating direction according to a movement of the movable member;

an insulation wall disposed frontward of the opening wall in the mating direction, the insulation wall disposed between a portion of the terminals protruding from the openings adjacent to each other in the rear position of the movable member; and a mating recess into which the mating housing is inserted along the mating direction toward the opening wall, wherein a first terminal of the terminals contacts a first mating terminal of the mating housing at a first position and a second terminal of the terminals contacts a second mating terminal of the mating housing at a second position adjacent to the first position, and in a temporary mating state in which the mating housing is inserted into the mating recess and the movable member is in the front position, the insulation wall is disposed between the first position and the second position in a direction perpendicular to the mating direction.

* * * * *